US011945024B2

(12) United States Patent
Janson et al.

(10) Patent No.: US 11,945,024 B2
(45) Date of Patent: Apr. 2, 2024

(54) MULLITE SHELL SYSTEMS FOR INVESTMENT CASTINGS AND METHODS

(71) Applicant: CARBO CERAMICS INC., Houston, TX (US)

(72) Inventors: Ray Janson, Houston, TX (US); Ryan Canfield, Houston, TX (US)

(73) Assignee: CARBO CERAMICS INC., Houston, TX (US)

( * ) Notice: Subject to any disclaimer, the term of this patent is extended or adjusted under 35 U.S.C. 154(b) by 96 days.

(21) Appl. No.: 17/597,627

(22) PCT Filed: Jul. 15, 2020

(86) PCT No.: PCT/US2020/042091
§ 371 (c)(1),
(2) Date: Jan. 14, 2022

(87) PCT Pub. No.: WO2021/011624
PCT Pub. Date: Jan. 21, 2021

(65) Prior Publication Data

US 2022/0234095 A1 Jul. 28, 2022

Related U.S. Application Data

(60) Provisional application No. 62/874,223, filed on Jul. 15, 2019.

(51) Int. Cl.

| | |
|---|---|
| ***B22C 3/00*** | (2006.01) |
| ***B22C 7/02*** | (2006.01) |
| ***B22C 9/04*** | (2006.01) |

(52) U.S. Cl.
CPC ..... *B22C 3/00* (2013.01); *B22C 7/02* (2013.01); *B22C 9/04* (2013.01)

(58) Field of Classification Search
CPC ..... B22C 3/00; B22C 7/02; B22C 9/04
See application file for complete search history.

(56) References Cited

U.S. PATENT DOCUMENTS

| | | | | |
|---|---|---|---|---|
| 5,297,615 | A | 3/1994 | Aimone et al. | |
| 2003/0136540 | A1* | 7/2003 | Springgate | G01N 23/05 164/4.1 |
| 2005/0092459 | A1 | 5/2005 | McGuire | |
| 2006/0130996 | A1* | 6/2006 | Bewlay | B22C 1/186 164/519 |
| 2007/0099793 | A1 | 5/2007 | Wilson | |
| 2017/0100770 | A1* | 4/2017 | Biederman | B22C 23/02 |
| 2018/0117668 | A1 | 5/2018 | Price | |
| 2019/0184450 | A1 | 6/2019 | Wilson et al. | |

OTHER PUBLICATIONS

International Search Report and Written Opinion dated Sep. 22, 2020, corresponding to Application No. PCT/US2020/042091.

* cited by examiner

*Primary Examiner* — Kevin P Kerns
*Assistant Examiner* — Steven S Ha
(74) *Attorney, Agent, or Firm* — Patterson + Sheridan, LLP

(57) ABSTRACT

A mullite shell mold for casting includes a facecoat layer containing ceramic flour. The mullite shell mold also includes a first layer disposed on the facecoat layer. The first layer can contain sintered ceramic media. The facecoat layer and the first layer can each contain less than 1 wt % crystalline silica.

20 Claims, 2 Drawing Sheets

MULLITE SHELL SYSTEMS FOR INVESTMENT CASTINGS AND METHODS

CROSS-REFERENCE TO RELATED APPLICATIONS

This application is a national stage application under 35 U.S.C. 371 of PCT/US2020/042091, filed Jul. 15, 2020, which claims priority to and the benefit of U.S. Patent Provisional Application Ser. No. 62/874,223, filed Jul. 15, 2019, which are hereby expressly incorporated by reference herein in their entireties as if fully set forth below and for all applicable purposes.

TECHNICAL FIELD

The present disclosure relates to methods and compositions for investment casting. More particularly, the present disclosure relates to mullite shell systems and methods of making mullite shell systems.

BACKGROUND

Investment casting is oftentimes used in the production of metal components having complex shapes or designs. Investment casting may involve first obtaining a disposable pattern, typically formed of wax or other thermoplastic material, of the desired metal casting. The disposable pattern is then dipped into a refractory slurry of fine particulate grains to provide a facecoat layer of slurry onto the disposable pattern. The disposable pattern having the facecoat layer is then contacted with coarse, dry particulates or "stucco" to provide a stucco coating or layer (also referred to herein as a "first layer") overlaying the facecoat layer. This process can be repeated with the stucco layer being overcoated with another, additional facecoat layer(s) and subsequent stucco layer(s) until the desired shell system or mold is achieved.

The facecoat layer(s) and stucco layer(s) often contain significant concentrations of crystalline silica, fused silica, and zircon. However, crystalline silica and fused silica can become respirable silica in manufacturing environments when the mold is broken apart and removed to reveal the cast component, creating regulatory compliance issues. And zircon, which is oftentimes included to reduce reactivity between the mold and the molten metal, can be expensive.

What is needed, therefore, is a shell system for investment castings that has a reduced silica content and is less expensive to manufacture, while, at the same time, reducing casting defects.

BRIEF DESCRIPTION OF THE DRAWINGS

The present disclosure may best be understood by referring to the following description and accompanying drawings that are used to illustrate embodiments of the present disclosure. In the drawings.

SUMMARY

In some embodiments, a mullite shell mold, the mullite shell mold includes a facecoat layer including ceramic flour. The shell mold has a first layer overlaying the facecoat layer, the first layer including sintered ceramic media, where the facecoat layer and the first layer each contain less than 1 wt % crystalline silica.

In some embodiments, a method of manufacturing a casting mold includes introducing a ceramic flour with a colloidal silica to provide a facecoat slurry. The method includes depositing the facecoat slurry onto a pattern having a thermoplastic material to provide a facecoat layer disposed on the pattern. The method includes depositing a stucco material onto the facecoat layer to provide a first layer disposed on the facecoat layer.

DETAILED DESCRIPTION

Mullite shell systems, or molds, for investment castings and methods for making same are described herein. The mullite shell mold can be a sintered mullite shell mold. The mullite shell can be or include any suitable amount of mullite. The mullite shell mold can be or include sintered kaolin, sintered bauxite, or sintered alumina or combinations thereof. In one or more embodiments, the mullite shell mold contains substantially no zircon, crystalline silica, or fused silica. As used herein, the term "substantially no" means no more than 0.05 wt % based on the total weight of the mullite shell mold. In an embodiment, the mullite shell mold contains no amount of zircon, crystalline silica, or fused silica.

The mullite shell molds disclosed herein can be obtained by any suitable methods. Suitable methods include first obtaining a disposable pattern of a desired metal casting. The disposable pattern can be formed from any suitable thermoplastic material, including but not limited to wax, polyolefins, polystyrene, and polyvinyl chloride. The disposable pattern can be coated with at least one ceramic containing slurry, for example, a facecoat slurry containing fine or small mesh particulates. A method of manufacturing a mullite shell mold is described below, for example, in FIG. 1. In one or more alternate embodiments, the disposable pattern can be coated with at least two, separate ceramic containing slurries.

Figure 1:
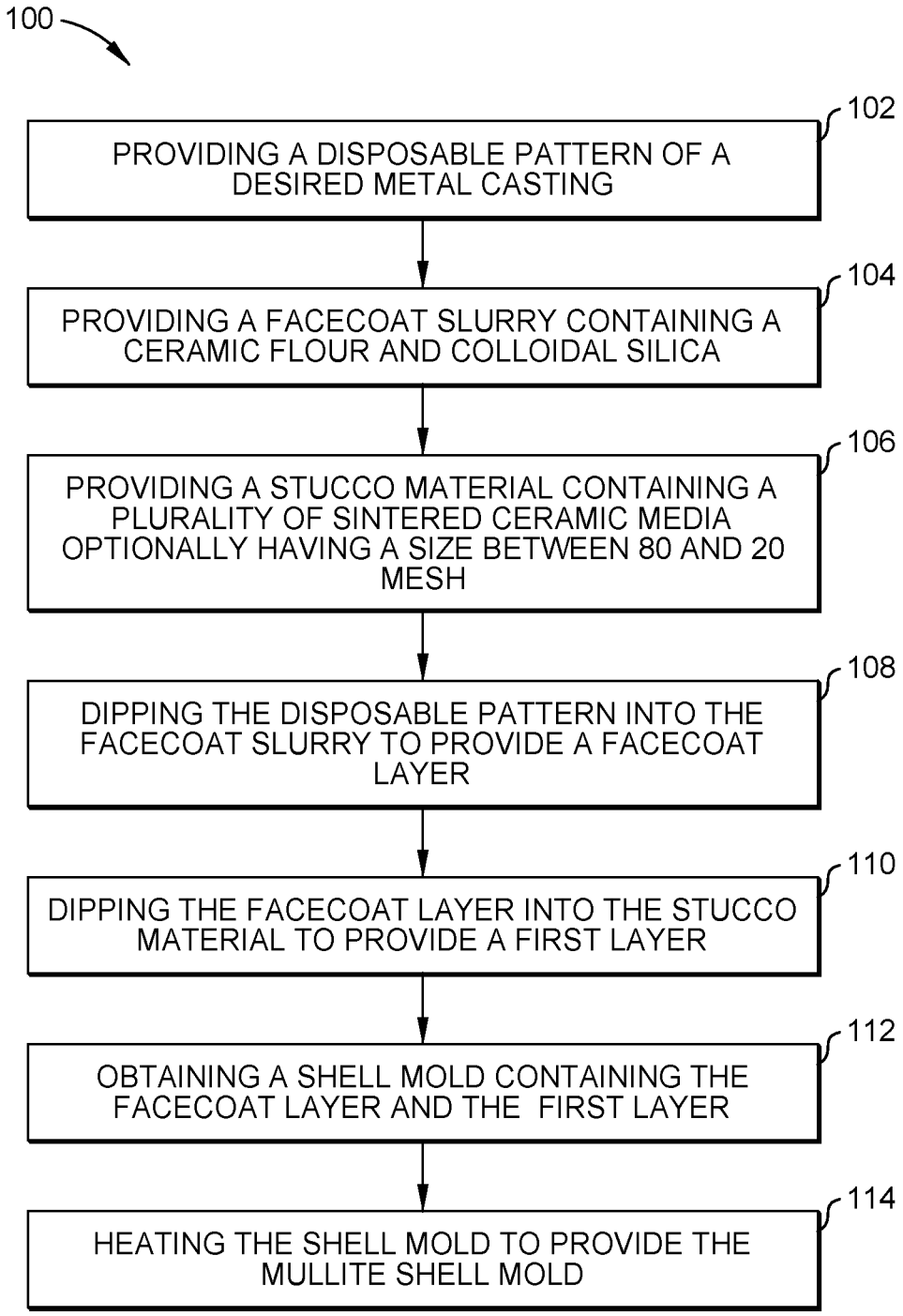
FIG. 1 illustrates a flowchart of a method for producing a mullite shell system, according to an embodiment.

FIG. 1 illustrates a flowchart of a method 100 for manufacturing a sintered shell mold described herein. The method 100 can include first providing a disposable pattern of a desired metal casting component, as at 102. A facecoat slurry can then be provided, as at 104. The facecoat slurry can contain a ceramic flour mixed with a colloidal silica. The term "flour," as used herein, is commonly used in the foundry industry and refers to finely ground refractory materials having particle sizes smaller than 150 microns or about 100 mesh. A flour size oftentimes used in the investment industry is a flour containing particle essentially 75% finer than 325 mesh (44 microns) and usually has a wide distribution range. The "mesh" sizes refer to U.S. Standard Screen Series. In one or more embodiments, the ceramic flour can be a 150 mesh flour, a 200 mesh flour, or a 325 mesh flour or combinations thereof. A 325 mesh flour, a 200 mesh flour, and a 150 mesh flour are each understood to mean that at least 95% of the particles pass through a 325 U.S. Standard Screen mesh, a 200 U.S. Standard Screen mesh, or a 150 U.S. Standard Screen mesh, respectively.

The ceramic flour can have any suitable composition. The ceramic flour can be an aluminosilicate material including silica and/or alumina in any suitable amounts. According to one or more embodiments, the ceramic flour can include less than 80 wt %, less than 60 wt %, less than 40 wt %, less than 30 wt %, less than 20 wt %, less than 10 wt %, or less than 5 wt % silica based on the total weight of the ceramic flour.

For example, the ceramic flour can include from about 0.1 wt % to about 70 wt % silica, from about 1 wt % to about 60 wt % silica, from about 2.5 wt % to about 50 wt % silica, from about 5 wt % to about 40 wt % silica, or from about 10 wt % to about 30 wt % silica. According to one or more embodiments, the ceramic flour can include at least about 30 wt %, at least about 50 wt %, at least about 60 wt %, at least about 70 wt %, at least about 80 wt %, at least about 90 wt %, or at least about 95 wt % alumina based on the total weight of the ceramic flour. For example, the ceramic flour can include from about 30 wt % to about 99.9 wt % alumina, from about 40 wt % to about 99 wt % alumina, from about 50 wt % to about 97 wt % alumina, from about 60 wt % to about 95 wt % alumina, or from about 70 wt % to about 90 wt % alumina. In one or more embodiments, the ceramic flour can include alumina, bauxite, kaolin, or any mixture thereof. For example, the ceramic flour can be composed entirely of or composed essentially of sintered alumina, bauxite, or kaolin, or any mixture thereof. The term "kaolin" is well known in the art and can include a raw material having an alumina content of at least about 40 wt % on a calcined basis and a silica content of at least about 40 wt % on a calcined basis. The term "bauxite" is well known in the art and can be or include a raw material having an alumina content of at least about 55 wt % on a calcined basis.

The ceramic flour can also include titanium dioxide and/or iron oxide in any suitable amounts. For example, the ceramic flour can include from about 0.01 wt %, about 0.1 wt %, about 0.5 wt %, about 1 wt %, or about 1.5 wt % to about 2 wt %, about 2.5 wt %, about 3 wt %, about 3.5 wt %, about 4 wt %, about 5 wt %, or about 10 wt % titanium dioxide based on the total weight of the ceramic flour. The ceramic flour can also include from about 0.01 wt %, about 0.1 wt %, about 0.5 wt %, about 1 wt %, or about 1.5 wt % to about 2 wt %, about 2.5 wt %, about 3 wt %, about 3.5 wt %, about 4 wt %, about 5 wt %, or about 10 wt % iron oxide based on the total weight of the ceramic flour. In one or more embodiments, the ceramic flour can include less than 4 wt %, less than 3 wt %, less than 2.5 wt %, or less than 2 wt % iron oxide based on the total weight of the ceramic flour. In other embodiments, the ceramic flour can include at least 4 wt %, at least 5 wt %, at least 7 wt %, or at least 9 wt % iron oxide based on the total weight of the ceramic flour.

The ceramic flour can contain substantially no zircon, free silica, crystalline silica, or fused silica. In one or more embodiments, the ceramic flour contains no amount of zircon, free silica, crystalline silica, or fused silica. In one or more embodiments, the ceramic flour does not contain any glass fibers.

The ceramic flour can have any suitable specific gravity, as measured in accordance with ASTM C830. In one example, the ceramic flour can have a specific gravity of at least about 2.5, at least about 2.7, at least about 3, at least about 3.3, or at least about 3.5. In another example, the ceramic flour can have a specific gravity from about 2.5 to about 4.0, about 2.7 to about 3.8, about 3.5 to about 4.2, about 3.8 to about 4.4, or about 3.0 to about 3.5.

The ceramic flour described herein can have a coefficient of thermal expansion, measured in accordance with ASTM E 228-85, from about 100° C. to about 1100° C., less than the coefficient of thermal expansion of silica sand and chromite. In one or more embodiments, the ceramic flour can have a coefficient of thermal expansion, from about 100° C. to about 1100° C., less than the coefficient of thermal expansion of silica sand and chromite and greater than the coefficient of thermal expansion of zircon. The ceramic flour can have a coefficient of thermal expansion from about 4 ($10^{-6}$ cm per cm per ° C.), about 5 ($10^{-6}$ cm per cm per ° C.), or about 5.5 ($10^{-6}$ cm per cm per ° C.) to about 6.5 ($10^{-6}$ cm per cm per ° C.), about 7 ($10^{-6}$ cm per cm per ° C.), or about 8 ($10^{-6}$ cm per cm per ° C.) from about 100° C. to about 1100° C. Certain embodiments include ceramic flour having a coefficient of thermal expansion, from about 100° C. to about 1100° C., selected from the group of: less than 15 ($10^{-6}$ cm per cm per ° C.), less than 12 ($10^{-6}$ cm per cm per ° C.), less than 10 ($10^{-6}$ cm per cm per ° C.), less than 8 ($10^{-6}$ cm per cm per ° C.), and less than 6 ($10^{-6}$ cm per cm per ° C.). Certain other embodiments include ceramic flour having a coefficient of thermal expansion, from about 100° C. to about 1100° C., selected from the group of: greater than 1 ($10^{-6}$ cm per cm per ° C.), greater than 2 ($10^{-6}$ cm per cm per ° C.), greater than 3 ($10^{-6}$ cm per cm per ° C.), greater than 4 ($10^{-6}$ cm per cm per ° C.), and greater than 5 ($10^{-6}$ cm per cm per ° C.).

The ceramic flour can be formed from sintered ceramic particles obtained by any suitable sintering process. In one or more embodiments, the ceramic flour can be formed or obtained by crushing, grinding, pulverizing, or milling (each referred to herein as "grinding") smooth, round and/or spherical sintered ceramic particles, such as ACCUCAST® manufactured by CARBO Ceramics Inc. of Houston, Texas. In one or more embodiments, the ceramic flour can be formed by grinding any suitable ceramic particulates, including but not limited to the ceramic particles described in U.S. Pat. Nos. 4,068,718, 4,427,068, 4,440,866, 5,188,175, 7,036,591, 7,387,752, 7,615,172, 8,614,157, 9,670,400, and 10,507,517 and U.S. Pre-Grant Publication Nos. 2007/0059528A1 and 2007/0099793A1, the entire disclosures of which are incorporated by reference herein. The ceramic flour can also be formed by grinding green (or uncalcined) pellets into a green flour and sintering the green flour to provide the ceramic flour. The ceramic flour can also be formed by grinding calcined pellets into a calcined flour and sintering the calcined flour to provide the ceramic flour.

Figure 2:
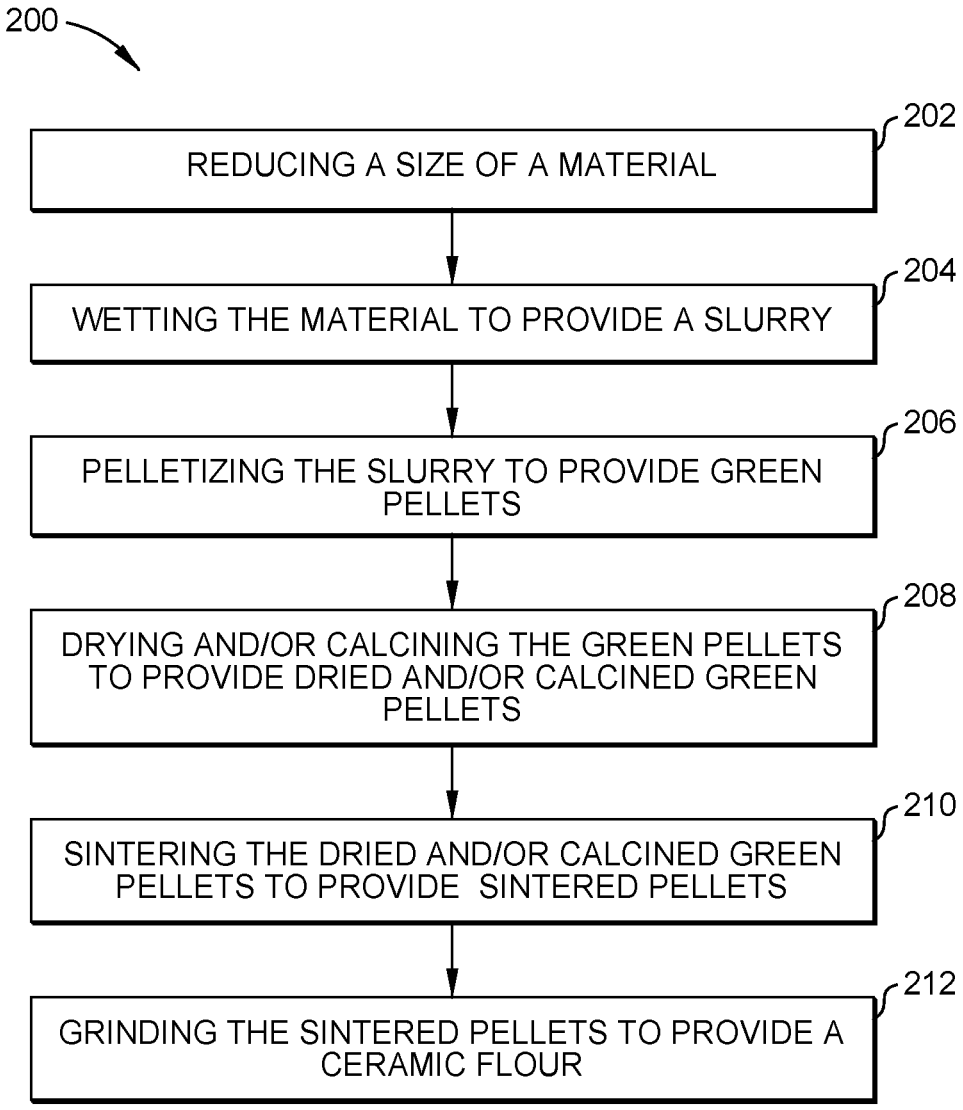
FIG. 2 illustrates a flowchart of a method for producing a ceramic flour, according to an embodiment.

FIG. 2 illustrates a flowchart of a method 200 for producing a ceramic flour described herein. The method 200 can include first reducing a size of a material, as at 202. The material can be or include a blend of clay, kaolin, bauxite, or alumina or combinations thereof. The size of the material can be reduced using a shredder and/or a blunger. The method 200 can also include wetting the material to produce a slurry, as at 204. The material can be wetted before, simultaneously with, and/or after the size of the material is reduced. For example, the material can be wetted in the blunger and/or a tank, or any other suitable vessel, until the slurry has a solids content from about 40% to about 60% (by weight). In one example, the material can be wetted by adding water. In one or more embodiments, the material can also or instead be wetted by adding one or more organic binders, inorganic binders, dispersants, pH-adjusting reagents, or a combination thereof. The organic binders can be or include polyvinyl alcohol, starch, polyvinylpyrolidone, poly(ethylene) glycol, EO-PO copolymer, and the like. The inorganic binders can be or include sodium silicates, bentonite clay, and the like. The dispersants can be or include bentonite clay, xanthan gum, surfactant (e.g., EH-9, PEG-PPGPEG), or a combination thereof. In other embodiments, the material can also or instead be wetted by adding alginic acid (e.g., sodium alginate), an organic binder, an inorganic binder, a dispersant, a pH-adjusting reagent, or a combination thereof, such as those described above.

The method 200 can also include pelletizing the slurry to produce green pellets, as at 206. The pelletizing can include introducing the slurry to any suitable pelletizing apparatus, including but not limited to the fluidizer described in U.S. Pat. No. 8,614,157, the disclosure of which is incorporated herein by reference, the nozzle of the drip cast system described in U.S. Pat. Nos. 8,865,631, 8,883,693, 9,145,210, 9,670,400, 10,077,398, 10,077,395, and 10,118,863, the disclosures of which are incorporated herein by reference, and a mixer, such as an Eirich mixer described in U.S. patent application Ser. Nos. 13/038,098 and 12/253,681, and in U.S. Pat. No. 4,623,630, the disclosures of which are incorporated herein by reference. The green pellets can be dried and/or calcined to provide dried and/or calcined pellets, as at 208. The drying and/or calcining of the pellets can occur in an atmosphere containing from about 0.5% to 21% oxygen using a pre-sintering device (e.g., a calciner). The dried and/or calcined pellets can then be sintered to provide sintered pellets, as at 210. The sintering of the pellets can include introducing the dried and/or calcined pellets to a sintering device, such as a kiln, rotary kiln, gas-fired kiln and the like. The sintering can include heating the pellets in a rotary kiln to a temperature from about 1200° C. to about 1450° C. or more for a residence time period from about 5 minutes, about 10 minutes, or about 20 minutes to about 40 minutes, about 50 minutes or about 60 minutes. In one or more embodiments, the residence time of the kiln is less than 60 minutes, less than 45 minutes, or less than 30 minutes. The method 200 can also include grinding the sintered pellets to provide the ceramic flour, as at 212. The grinding can take place in any suitable grinder, grinding mill, or the like.

The facecoat slurry can be provided by blending the ceramic flour with a colloidal silica composition. The term "colloidal silica" is well known in the art and refers to an aqueous suspension of fine amorphous silica particles having a size of less than 5 nm. The facecoat slurry can contain colloidal silica and ceramic flour in any suitable amounts. In one or more embodiments, the facecoat slurry can contain at least 40 wt %, at least 60 wt %, or at least 70 wt % ceramic flour and at least 10 wt %, at least 15 wt %, or at least 20 wt % colloidal silica. For example, the facecoat slurry can contain about 10 wt %, about 25 wt %, about 50 wt %, or about 65 wt % to about 70 wt %, about 75 wt %, about 80 wt %, or about 85 wt % ceramic flour and about 5 wt %, about 12 wt %, about 18 wt %, or about 22 wt % to about 25 wt %, about 30 wt %, about 35 wt %, or about 40 wt % colloidal silica.

In one or more embodiments, the facecoat slurry contains less than 2 wt %, less than 1 wt %, less than 0.5 wt %, or less than 0.1 wt % zircon, less than 2 wt %, less than 1 wt %, less than 0.5 wt %, or less than 0.1 wt % crystalline silica, less than 2 wt %, less than 1 wt %, less than 0.5 wt %, or less than 0.1 wt % free silica, and/or less than 2 wt %, less than 1 wt %, less than 0.5 wt %, or less than 0.1 wt % fused silica. The facecoat slurry can contain substantially no zircon, crystalline silica, or fused silica. In one or more embodiments, the facecoat slurry contains no amount of zircon, crystalline silica, or fused silica. In one or more embodiments, the facecoat slurry does not contain any glass fibers.

Returning to FIG. 1, the method 100 can also include providing a stucco material containing dry, sintered ceramic media, as at 106. The sintered ceramic media can have any suitable shape. In one or more embodiments, the sintered ceramic media can have a spherical shape, spheroidal shape, such as the shape of an oblate spheroid or prolate spheroid, or a substantially round and spherical shape. As used herein, the term "substantially round and spherical" and related forms is defined to mean an average ratio of minimum diameter to maximum diameter of about 0.8 or greater, or having an average sphericity value of about 0.8 or greater compared to a Krumbein and Sloss chart.

The sintered ceramic media can have any suitable size. The sintered ceramic media disclosed herein can have a size in a range between about 6 and 270 U.S. Mesh. For example, the size of the sintered ceramic media can be expressed as a grain fineness number (GFN) in a range of from about 15 to about 110, or from about 25 to about 85, or from about 40 to about 70. According to such examples, a sample of sintered ceramic media can be screened in a laboratory for separation by size, for example, intermediate sizes between 20, 30, 40, 50, 70, 100 and 140 U.S. mesh sizes to determine GFN. The correlation between sieve size and GFN can be determined according to Procedure 106-87-S of the American Foundry Society Mold and Core Test Handbook, which is known to those of ordinary skill in the art.

The sintered ceramic media can have a mesh size of at least about 10 mesh, at least about 16 mesh, at least about 20 mesh, at least about 25 mesh, at least about 30 mesh, at least about 35 mesh, or at least about 40 mesh. According to several embodiments, the sintered ceramic media have a mesh size from about 16 mesh, about 20 mesh, about 30 mesh, or about 40 mesh to about 50 mesh, about 70 mesh, about 100 mesh, about 140 mesh, or about 200 mesh. According to several embodiments, the sintered ceramic media have a mesh size from about 20 mesh to about 140 mesh, from about 30 mesh to about 100 mesh, from about 40 mesh to about 70 mesh, from about 50 mesh to about 100 mesh, or from about 70 mesh to about 140 mesh.

The sintered ceramic media can be any suitable conventional ceramic media, such as ceramic foundry media. In one or more embodiments, the sintered ceramic media can include ACCUCAST manufactured by CARBO Ceramics Inc. of Houston, Texas. In one or more embodiments, the sintered ceramic media can be or include the ceramic particles described in U.S. Pat. Nos. 4,068,718, 4,427,068, 4,440,866, 5,188,175, 7,036,591, 7,387,752, 7,615,172, 8,614,157, 9,670,400, and 10,507,517 and U.S. Pre-Grant Publication Nos. 2007/0059528A1 and 2007/0099793A1, the entire disclosures of which are incorporated by reference herein.

The sintered ceramic media can have any suitable composition. The sintered ceramic media can be an aluminosilicate material including silica and/or alumina in any suitable amounts. According to one or more embodiments, the sintered ceramic media can include less than 80 wt %, less than 60 wt %, less than 40 wt %, less than 30 wt %, less than 20 wt %, less than 10 wt %, or less than 5 wt % silica based on the total weight of the sintered ceramic media. For example, the sintered ceramic media can include from about 0.1 wt % to about 70 wt % silica, from about 1 wt % to about 60 wt % silica, from about 2.5 wt % to about 50 wt % silica, from about 5 wt % to about 40 wt % silica, or from about 10 wt % to about 30 wt % silica. According to one or more embodiments, the sintered ceramic media can include at least about 30 wt %, at least about 50 wt %, at least about 60 wt %, at least about 70 wt %, at least about 80 wt %, at least about 90 wt %, or at least about 95 wt % alumina based on the total weight of the sintered ceramic media. For example, the sintered ceramic media can include from about 30 wt % to about 99.9 wt % alumina, from about 40 wt % to about 99 wt % alumina, from about 50 wt % to about 97 wt % alumina, from about 60 wt % to about 95 wt % alumina, or from about 70 wt % to about 90 wt % alumina. In one or more embodiments, the sintered ceramic media can include alumina, bauxite, kaolin, or any mixture thereof. For example, the sintered ceramic media can be composed entirely of or composed essentially of sintered alumina, bauxite, or kaolin, or any mixture thereof.

The sintered ceramic media can also include titanium dioxide and/or iron oxide in any suitable amounts. For example, the sintered ceramic media can include from about 0.01 wt %, about 0.1 wt %, about 0.5 wt %, about 1 wt %, or about 1.5 wt % to about 2 wt %, about 2.5 wt %, about 3 wt %, about 3.5 wt %, about 4 wt %, about 5 wt %, or about 10 wt % titanium dioxide based on the total weight of the sintered ceramic media. The sintered ceramic media can also include from about 0.01 wt %, about 0.1 wt %, about 0.5 wt %, about 1 wt %, or about 1.5 wt % to about 2 wt %, about 2.5 wt %, about 3 wt %, about 3.5 wt %, about 4 wt %, about 5 wt %, or about 10 wt % iron oxide based on the total weight of the sintered ceramic media. In one or more embodiments, the sintered ceramic media can include less than 4 wt %, less than 3 wt %, less than 2.5 wt %, or less than 2 wt % iron oxide based on the total weight of the sintered ceramic media. In other embodiments, the sintered ceramic media can include at least 4 wt %, at least 5 wt %, at least 7 wt %, or at least 9 wt % iron oxide based on the total weight of the sintered ceramic media.

In one or more embodiments, the sintered ceramic media contains less than 2 wt %, less than 1 wt %, less than 0.5 wt %, or less than 0.1 wt % zircon, less than 2 wt %, less than 1 wt %, less than 0.5 wt %, or less than 0.1 wt % crystalline silica, less than 2 wt %, less than 1 wt %, less than 0.5 wt %, or less than 0.1 wt % free silica, and/or less than 2 wt %, less than 1 wt %, less than 0.5 wt %, or less than 0.1 wt % fused silica. The sintered ceramic media can contain substantially no zircon, free silica, crystalline silica, or fused silica. In one or more embodiments, the sintered ceramic media contains no amount of zircon, free silica, crystalline silica, or fused silica.

The sintered ceramic media can have any suitable specific gravity, as measured in accordance with ASTM C830. In one example, the sintered ceramic media can have a specific gravity of at least about 2.5, at least about 2.7, at least about 3, at least about 3.3, or at least about 3.5. In another example, the sintered ceramic media can have a specific gravity from about 2.5 to about 4.0, about 2.7 to about 3.8, about 3.5 to about 4.2, about 3.8 to about 4.4, or about 3.0 to about 3.5.

The sintered ceramic media described herein can have a coefficient of thermal expansion, measured in accordance with ASTM E 228-85, from about 100° C. to about 1100° C., less than the coefficient of thermal expansion of silica sand and chromite. In one or more embodiments, the sintered ceramic media can have a coefficient of thermal expansion, from about 100° C. to about 1100° C., less than the coefficient of thermal expansion of silica sand and chromite and greater than the coefficient of thermal expansion of zircon. The sintered ceramic media can have a coefficient of thermal expansion from about 4 ($10^{-6}$ m per cm per ° C.), about 5 ($10^{-6}$ cm per cm per ° C.), or about 5.5 ($10^{-6}$ cm per cm per ° C.) to about 6.5 ($10^{-6}$ cm per cm per ° C.), about 7 ($10^{-6}$ cm per cm per ° C.), or about 8 ($10^{-6}$ cm per cm per ° C.) from about 100° C. to about 1100° C. Certain embodiments include sintered ceramic media having a coefficient of thermal expansion, from about 100° C. to about 1100° C., selected from the group of: less than 15 ($10^{-6}$ cm per cm per ° C.), less than 12 ($10^{-6}$ cm per cm per ° C.), less than 10 ($10^{-6}$ cm per cm per ° C.), less than 8 ($10^{-6}$ cm per cm per ° C.), and less than 6 ($10^{-6}$ cm per cm per ° C.). Certain other embodiments include sintered ceramic media having a coefficient of thermal expansion, from about 100° C. to about 1100° C., selected from the group of: greater than 1 ($10^{-6}$ cm per cm per ° C.), greater than 2 ($10^{-6}$ cm per cm per ° C.), greater than 3 ($10^{-6}$ cm per cm per ° C.), greater than 4 ($10^{-6}$ cm per cm per ° C.), and greater than 5 ($10^{-6}$ cm per cm per ° C.).

In one or more embodiments, the sintered ceramic media has the same composition as the ceramic flour. For example, the ceramic flour can be provided by grinding a sintered ceramic media that is the same as, or has the same composition as, the sintered ceramic media used in the stucco material. In one or more embodiments, the stucco material does not contain any glass fibers.

The stucco material can be provided by obtaining a dry plurality of the sintered ceramic media. The stucco material can be adapted to be deposited on the facecoat layer using any suitable system. For example, the dry plurality of sintered ceramic media can be aerated to provide a fluidized or ebullated bed of sintered ceramic media into which the facecoat layer may be submerged, dipped or otherwise disposed for deposition of the stucco material onto the facecoat layer. Alternatively, the stucco material can be applied to the facecoat layer using a falling media system, whereby the sintered ceramic media falls, for example, in the form of a curtain, onto the facecoat layer to provide the first layer.

The method 100 can also include dipping the disposable pattern into the facecoat slurry to provide a facecoat layer, as at 108. The facecoat layer can have the same composition as the facecoat slurry described herein. The facecoat layer can have any suitable thickness. In one or more embodiments, the facecoat layer can have a thickness of about 0.01 inch, about 0.02 inch, or about 0.04 inch to about 0.08 inch, about 0.1 inch, about 0.2 inch, about 0.4 inch, or about 0.5 inch. The facecoat layer can be provided by dipping the disposable pattern into facecoat slurry at least once, and in some embodiments, two or more times to achieve a facecoat layer having a desired thickness.

The method 100 can also include depositing the stucco material onto the disposable pattern having the facecoat layer to provide a first layer, as at 110. The first layer can have the same composition as the stucco material described herein. The first layer can be provided by disposing the dry plurality of sintered ceramic media onto the facecoat layer as described herein.

In one or more embodiments, a plurality of alternating layers overlaying the facecoat layer and the first layer can be formed by dipping the disposable pattern having the first layer into the facecoat slurry to provide an intermediate layer disposed directly on and surrounding the first layer and dipping the disposable pattern having the intermediate layer into the stucco material to provide a second layer disposed directly on and surrounding the intermediate layer. In one or more embodiments, the alternating layers can include any sequence of layers including at least one layer of the facecoat slurry and at least one layer of the stucco material. Thus, where A represents the facecoat slurry and B represents the stucco material, sequences of layers such as AAABAB, AABABAB, ABABABABAB, AABBAABB, AABAAB, ABBABB can all be sequences of alternating layers forming or at least partially forming the shell mold.

A shell mold is provided once a desired number of layers is built-up, as at 112. The shell mold can have any suitable composition. In one or more embodiments, the shell mold is composed entirely of or composed essentially of the disposable pattern and the layer(s) of slurry described herein and formed thereon. The shell mold can then be dried and heated, for example, at calcining and/or sintering temperatures from about 800° C. to about 1230° C. or more, to provide the mullite shell mold, as at 114. The drying and heating, as at 114, can be sufficient to detach, disengages, or vaporize the disposable pattern, thus resulting in the removal of the disposable pattern from the shell mold. In one or more embodiments, the mullite shell mold can be a calcined mullite shell mold or a sintered mullite shell mold.

It is understood that modifications to the embodiments may be made as might occur to one skilled in the field of the present disclosure within the scope of the appended claims. All embodiments contemplated hereunder which achieve the objects of the present disclosure have not been shown in complete detail. Other embodiments may be developed without departing from the spirit of the present disclosure or from the scope of the appended claims. Although the present disclosure has been described with respect to specific details, it is not intended that such details should be regarded as limitations on the scope of the present disclosure, except to the extent that they are included in the accompanying claims.

What is claimed is:

1. A shell mold, the shell mold comprising:
a facecoat layer comprising ceramic flour; and
a first layer overlaying the facecoat layer, the first layer comprising sintered ceramic media, wherein:
the facecoat layer and the first layer each contain less than 1 wt % crystalline silica, and
the sintered ceramic media comprises sintered, substantially round and spherical kaolin particles having a mesh size from about 10 mesh to about 100 mesh.

2. The shell mold of claim 1, wherein the mullite shell mold comprises substantially no crystalline silica.

3. The shell mold of claim 1, wherein the mullite shell mold comprises substantially no fused silica.

4. The shell mold of claim 1, wherein the mullite shell mold comprises substantially no zircon.

5. The shell mold of claim 1, further comprising:
an intermediate layer overlaying the first layer, the intermediate layer comprising ceramic flour; and
a second layer overlaying the intermediate layer, the second layer comprising a second sintered ceramic media.

6. The shell mold of claim 5, wherein the facecoat layer and the intermediate layer comprise sintered kaolin, sintered bauxite, or sintered alumina or any combination thereof.

7. The shell mold of claim 6, wherein the second sintered ceramic media are sintered, substantially round and spherical particles having a size from about 10 mesh to about 100 mesh.

8. The shell mold of claim 7, wherein the sintered, substantially round and spherical particles have an iron content of less than 2 wt %.

9. The shell mold of claim 1, wherein the sintered ceramic media has a size of about 40 mesh to about 70 mesh.

10. The shell mold of claim 1, wherein the first sintered ceramic media has a specific gravity of about 2.5 to about 4.

11. The shell mold of claim 1, wherein the first ceramic flour has a specific gravity of about 2.5 to about 4.

12. A method of manufacturing a casting mold, comprising:
introducing a ceramic flour with a colloidal silica to provide a facecoat slurry;
depositing the facecoat slurry onto a pattern comprising a thermoplastic material to provide a facecoat layer disposed on the pattern; and
depositing a stucco material onto the facecoat layer to provide a first layer disposed on the facecoat layer, the stucco material comprising sintered, substantially round and spherical kaolin particles having a mesh size from about 10 mesh to about 100 mesh.

13. The method of claim 12, wherein the ceramic flour consists essentially of sintered alumina, sintered bauxite, or sintered kaolin, or any mixture thereof.

14. The method of claim 12, wherein the facecoat slurry comprises substantially no crystalline silica.

15. The method of claim 12, wherein the facecoat slurry comprises substantially no fused silica.

16. The method of claim 12, wherein the facecoat slurry comprises substantially no zircon.

17. The method of claim 12, wherein the stucco material comprises substantially no crystalline silica.

18. The method of claim 12, wherein the stucco material comprises substantially no fused silica.

19. The method of claim 12, wherein the stucco material comprises substantially no zircon.

20. The method of claim 10, wherein the sintered, substantially round and spherical kaolin particles have an iron content of less than 2 wt %.

* * * * *